US005484327A

United States Patent [19]

Kovach

[11] Patent Number: 5,484,327

[45] Date of Patent: Jan. 16, 1996

[54] METHOD AND APPARATUS FOR SIMULTANEOUSLY GRINDING A WORKPIECE WITH FIRST AND SECOND GRINDING WHEELS

[75] Inventor: Joseph A. Kovach, Aurora, Ohio

[73] Assignee: Eaton Corporation, Cleveland, Ohio

[21] Appl. No.: 79,430

[22] Filed: Jun. 21, 1993

[51] Int. Cl.[6] ..... B24B 5/00

[52] U.S. Cl. ..... 451/49; 451/58; 451/190; 451/194; 451/209; 451/242; 451/11

[58] Field of Search ..... 451/49, 51, 58, 451/190, 194, 195, 209, 210, 242, 132, 134, 179, 11, 10, 189

[56] References Cited

U.S. PATENT DOCUMENTS

| | | | |
|---|---|---|---|
| Re. 28,082 | 7/1974 | Price . | |
| 403,721 | 5/1989 | Ashworth . | |
| 1,794,975 | 3/1931 | Mershon . | |
| 1,826,663 | 10/1931 | Jopp . | |
| 1,958,001 | 5/1934 | Heim . | |
| 1,998,755 | 4/1935 | Giffin | 451/190 |
| 2,700,255 | 1/1955 | Meier | 451/210 |
| 2,794,304 | 6/1957 | Frankewicz et al. | 451/49 |
| 3,636,664 | 1/1972 | Price . | |
| 3,655,957 | 4/1972 | McIntosh . | |
| 3,667,167 | 6/1972 | Happel . | |
| 3,690,072 | 7/1972 | Price . | |
| 3,716,949 | 2/1973 | Price et al. . | |
| 3,747,283 | 7/1973 | Price . | |
| 3,756,354 | 9/1973 | Clark . | |
| 3,763,600 | 10/1973 | Shank . | |
| 3,812,627 | 5/1974 | Gebel et al. . | |
| 3,934,185 | 1/1976 | Schoonover et al. . | |
| 3,998,010 | 12/1976 | Harris . | |
| 4,063,906 | 12/1977 | Wetzels | 451/49 |
| 4,439,951 | 4/1984 | Oppelt et al. . | |
| 4,441,280 | 4/1984 | Wetzels et al. | 451/242 |
| 4,631,870 | 12/1986 | Sun et al. . | |
| 4,984,934 | 1/1991 | Suzuki et al. . | |
| 5,186,135 | 2/1993 | Kovach . | |

*Primary Examiner*—Bruce M. Kisliuk
*Assistant Examiner*—Eileen P. Morgan
*Attorney, Agent, or Firm*—Marvin L. Union

[57] ABSTRACT

A method and apparatus for grinding a workpiece which is supported for rotation about a first axis with a first grinding wheel supported for rotation about a second axis and a second grinding wheel supported for rotation about a third axis. The first grinding wheel engages with the workpiece in a location which is substantially diametrically opposed to the location at which the second grinding wheel engages with the workpiece. Control means are disclosed for controlling the radial grinding force imparted to the workpiece by the first and second grinding wheels so that the force imparted to the workpiece from the first grinding wheel is substantially equal and opposed to the force imparted to the workpiece by the second grinding wheel to prevent distortion of the workpiece.

41 Claims, 4 Drawing Sheets

METHOD AND APPARATUS FOR SIMULTANEOUSLY GRINDING A WORKPIECE WITH FIRST AND SECOND GRINDING WHEELS

BACKGROUND OF THE INVENTION

The present invention relates to a method and apparatus for grinding a rotating workpiece and more particularly, to a method and apparatus for simultaneously grinding a workpiece with first and second grinding wheels which may be orientated at compound angles to the workpiece. The first grinding wheel engages with the workpiece at a location which is substantially diametrically opposed to the location at which the second grinding wheel engages with the workpiece and the radial grinding force imparted to the workpiece by the first grinding wheel is substantially equal and opposed to the radial grinding force imparted to the workpiece by the second grinding wheel to prevent distortion of the workpiece in a radial direction.

Known grinding machines operate on a rotating workpiece with a single grinding wheel. The grinding wheel imparts radial, tangential and axial forces to the workpiece. The radial and tangential forces tend to distort the workpiece in a radial direction relative to the axis of rotation of the workpiece. Distortion of the workpiece results in reduced component accuracy, reduced grinding rates, and may even mandate additional costly straightening procedures to remove any grinding induced distortion from the workpiece.

The distortion of the workpiece caused by the radial and tangential forces exerted by the grinding wheel on the workpiece is especially disadvantageous when long, thin, cylindrical workpieces are ground. The long, thin workpieces are particularly susceptible to distortion due to grinding forces. This is especially critical when the workpiece is formed from a relatively brittle material such as a ceramic material which can break when subjected to radial forces. The distortion effected by the grinding is particularly disadvantageous when finishing internal combustion engine valves which have a long, relatively thin stem portion and is particularly troublesome when the valves are constructed of a ceramic material. In practice, the stems of ceramic engine valves are especially sensitive to distortion in a radial direction and break if the grinding force is too great. This results in a relatively slow grinding procedure on the valve stems of internal combustion engine valves to reduce the grinding forces imparted to the ceramic engine valve and to minimize distortion thereof.

The prior art also discloses the use of dual wheel surface grinders which are capable of grinding two flat surfaces on a non-rotating workpiece. The known dual wheel surface grinders are not operable to grind cylindrical surfaces on a workpiece.

It is also currently impractical to grind elongate cylindrical ceramic workpieces such as ceramic valve on a centerless grinder due to the fact that the ceramic blanks are not normally perfectly straight or round due to the casting and sintering process which creates some distortion in the valve blanks. The distorted ceramic valve blanks can not be straightened prior to grinding and warped blanks would tend to break in a centerless grinder due to their lack of concentricity. Also, centerless grinders using diamond grinding wheels are very costly and difficult to dress.

SUMMARY OF THE INVENTION

The present invention relates to a dual wheel grinding machine and a method of simultaneously grinding a rotating workpiece with first and second grinding wheels where the radial and tangential force imparted to the workpiece by the first grinding wheel are substantially opposed to the radial and tangential force imparted to the workpiece by the second grinding wheel. The first grinding wheel is preferably a roughing grinding wheel which leads the second grinding wheel which is preferably a finish grinding wheel. The method and apparatus provides for the production of a finished product with higher quality, closer tolerances and faster through-put due to the use of the dual grinding wheels.

Another provision of the present invention is to provide a dual wheel grinding machine including workpiece supporting means for supporting a workpiece for rotation about a first axis of rotation, first and second grinding wheels supported for rotation about a second and third axis of rotation, respectively, the first, second and third axes of rotation being substantially parallel, the first grinding wheel being operable to engage the workpiece at a location which is substantially diametrically opposed to a location at which the second grinding wheel engages with the workpiece and control means for controlling the radial grinding force imparted to the workpiece by the second and third grinding wheels to control the radial grinding force imparted to the workpiece by the first grinding wheel to be substantially equal and opposed to the radial grinding force imparted to the workpiece by the second grinding wheel to prevent distortion of the workpiece.

Another provision of the present invention is to provide a dual wheel grinding machine including workpiece supporting means for supporting a workpiece for rotation about a first axis of rotation, a first grinding wheel supported for rotation about a second axis of rotation, a second grinding wheel supported for rotation about a third axis of rotation, the second and third axes of rotation each being disposed at an acute angle relative to the first axis of rotation, the first grinding wheel being operable to engage with the workpiece at a location which is substantially diametrically opposed to the location at which the second grinding wheel engages with the workpiece, and means for controlling the radial grinding force imparted to the workpiece by the first and second grinding wheels to control the radial grinding force imparted to the workpiece by the first grinding wheel to be substantially equal and opposed to the radial grinding force imparted to the workpiece by the second grinding wheel to prevent distortion of the workpiece.

Another provision of the present invention is to provide a new and improved dual wheel grinding machine as set forth in the preceding paragraph wherein the second and third axes of rotation are non-intersecting.

Still another provision of the present invention is to provide a method of grinding an internal combustion engine valve using first and second grinding wheels which simultaneously grind the valve including the steps of supporting an engine valve for rotation about a first axis of rotation, rotating a first grinding wheel about a second axis for rotation, rotating a second grinding wheel about a third axis of rotation, simultaneously engaging the first and second grinding wheels with the engine valve so that the first grinding wheel engages with the engine valve at a location which is substantially diametrically opposed to the location at which the second grinding wheel engages with the engine valve, and controlling the radial grinding force imparted to the engine valve by the first and second grinding wheels so that the first grinding wheel imparts a radial grinding force to the engine valve which is opposed to the radial grinding force imparted to the engine valve by the second grinding wheel to prevent distortion of the engine valve.

BRIEF DESCRIPTION OF THE DRAWINGS

The foregoing are the features of the present invention which will be more apparent upon consideration of the following description taken in conjunction with the accompanying drawings wherein.

DESCRIPTION OF PREFERRED EMBODIMENTS

Figure 1:
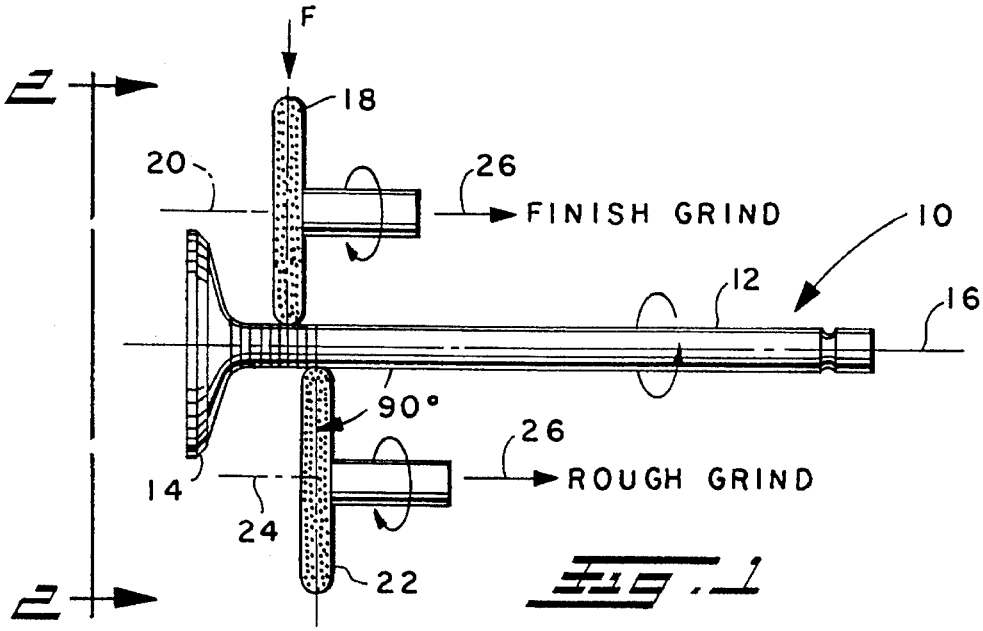
FIG. 1 is a top schematic view of an engine valve being ground in accordance with the principals of the present invention.

Referring the figures and more particularly to FIG. 1, a workpiece 10, which in the preferred embodiment is an internal combustion engine valve is disclosed. The internal combustion engine valve 10 includes an elongate valve stem portion 12 and a valve head portion 14 as is well known. The valve 10 is supported in a well known manner, not illustrated, for rotation about an axis of rotation 16 in a grinding machine. As is well known, the grinding machine is adapted to support the valve 10 and affect rotation thereof about the axis 16. The axis of rotation 16 is substantially coextensive with the central longitudinal axis of the valve stem portion 12.

A first grinding wheel 22 and a second grinding wheel 18 are supported in the grinding machine to effect finishing of the surface of the valve 10. The grinding wheel 22 is supported for rotation about a first axis of rotation 24 which is substantially parallel to the axis of rotation 16 and the grinding wheel 18 is supported for rotation about a second axis of rotation 20 which is substantially parallel to the axis of rotation 16. The grinding wheel 22 is preferably a roughing grinding wheel and the grinding wheel 18 is preferably a finishing grinding wheel. Each of the grinding wheels 18 and 22 is adapted to move in an axial direction as is indicated by the arrow 26 to finish the surface of valve 10. Preferably the grinding wheel 22 leads the grinding wheel 18 as the wheels 18, 22 move axially to finish the surface of valve 10. The wheel 22 moves ahead of wheel 18 as wheels 18 and 22 progress axially along the valve 10 to rough grind the surface of the valve 10 before finish grinding the surface of the valve 10. While wheel 22 is described as engaging the valve 10 at a location which is substancially opposed to the location at which wheel 18 engages valve 10, in fact wheel 22 slightly proceeds wheel 18 as the wheels move axially along valve 10 to rough grind the surface of the valve prior to finish grinding the surface of the valve 10.

As is illustrated in FIG. 1, the grinding wheel 22 engages with the workpiece 10 at a location which is substantially diametrically opposed to the location at which the grinding wheel 18 engages with the workpiece 10. Each of the grinding wheels exert a radial force $F_R$, a tangential force $F_T$ and an axial force $F_A$ on the workpiece 10 as is more fully illustrated in FIG. 1 and 2. The radial force $F_R$ is in a direction perpendicular to the longitudinal axis of the workpiece 10, the tangential force $F_T$ is disposed substantially tangential to the surface of the workpiece 10 at which the grinding wheel engages and the axial force $F_A$ is exerted on the workpiece in a direction substantially parallel to the direction of axial feed as indicated by the arrow 26. When the workpiece 10 is supported for rotation, the grinding wheels 18 and 22 simultaneously engage the surface of the workpiece 10 to effect grinding thereof. It should be apparent that the location at which the grinding wheel 22 engages the surface of the workpiece 10 is substantially diametrically opposed to the location at which the grinding wheel 18 engages the surface of the workpiece. The grinding wheel 22 is preferably a roughing grinding wheel which performs rough finishing of the surface of the workpiece 10 and the grinding wheel 18 is a finish grinding wheel which finish grinds the surface of the workpiece 10 after it has been rough ground. The grinding wheels 18 and 22 cannot simultaneously engage and grind on the same axial surface portion of the workpiece 10 due to the fact that the wheel 22 would constantly rough up the surface which has been finish-ground by the wheel 18. Accordingly, it is desirable to have the rough grinding wheel 22 lead in an axial direction along valve 10 the finish grinding wheel 18 by a small amount so that the surface of the workpiece can be sequentially and simultaneously rough ground and then finish ground. Simultaneously roughing and finish grinding the workpiece increases the thru-put and provides higher quality finished products by minimizing distortion of the workpiece during the grinding process. Even though the grinding wheel 22 leads the grinding wheel 18, grinding wheel 22 engages with the surface of the workpiece at a location which is substantially diametrically opposed to the location at which the grinding wheel 18 engages with the workpiece to enable the radial force exerted on the workpiece by grinding wheel 22 to be substantially opposed to the radial grinding force exerted on the workpiece by grinding wheel 18. This allows the radial grinding force exerted by grinding wheels 18 and 22 to substantially cancel each other out which minimizes distortion of the workpiece in a radial direction. This is particularly critical in preventing distortion in thin, elongated workpieces.

Figure 2:
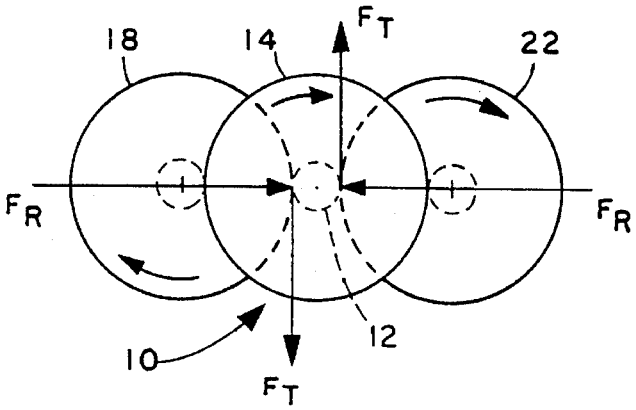
FIG. 2 is an end view of FIG. 1 taken approximately along the lines 2—2 more fully illustrating the forces acting on the workpiece.

As is disclosed in FIG. 2, the tangential force $F_T$ imparted to the workpiece 10 by the grinding wheel 22 can be disposed in an opposite direction to the tangential force $F_T$ exerted on workpiece 10 by grinding wheel 18 to prevent distortion of the workpiece 10 by the tangential forces imparted to the workpiece by grinding wheels 18 and 22. By controlling the radial and tangential forces exerted by each of the grinding wheels 18 and 22, the radial and tangential forces exerted by grinding wheel 18 can be controlled to be substantially equal to and opposed to the radial and tangential forces imparted to workpiece 10 by grinding wheel 22.

Figure 4:
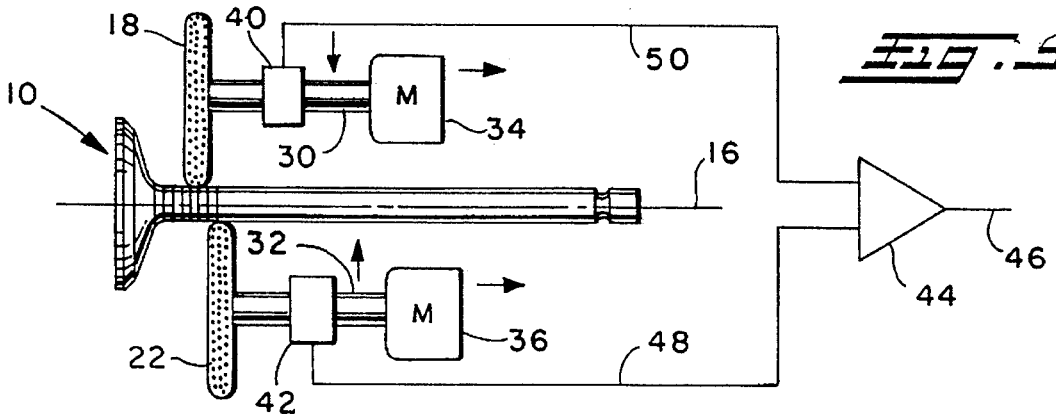
FIG. 4 schematically illustrates a closed-loop control system utilizing force sensors for controlling the force imparted to the workpiece by the first and second grinding wheel.
Figure 5:
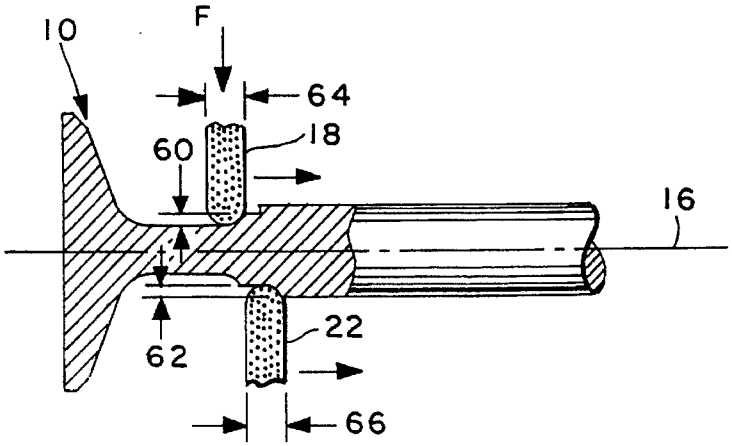
FIG. 5 schematically illustrates controlling the force imparted to the workpiece by the grinding wheels by controlling the depth of cut, sharpness of the grinding wheel, width of the wheel, axial feed rate and speed of the wheel.

FIGS. 4 and 5 disclose various methods and apparatus for controlling the grinding forces exerted on the workpiece by the grinding wheels 18 and 22. FIG. 4 illustrates control means for controlling the grinding forces imparted to the workpiece by the first and second grinding wheels which includes force sensors 40 and 42 disposed in a closed-loop-feedback system. Force sensor 40 is located on a shaft 30 which supports grinding wheel 18 for rotation and is operable to sense the radial and tangential forces imparted to the workpiece 10 by the grinding wheel 18. Force sensor 42 is disposed on a shaft 32 which supports grinding wheel 22 for rotation and is operable to sense the radial and tangential grinding forces imparted to the workpiece 10 by the grinding wheel 22. A motor 34 is provided for driving shaft 30 and wheel 18 and a motor 36 is provided to drive shaft 32 and wheel 22. The output of force sensor 40 is directed via line 50 to an operational amplifier 44 and the output of force sensor 42 is directed along line 48 to the operational amplifier 44. The operational amplifier 44 determines the difference between the force imparted to the workpiece 10 by the grinding wheel 18 and the force imparted to the workpiece 10 by the grinding wheel 22 and establishes an error signal on line 46 which is indicative of the difference. The error signal on line 46 will then be directed to the motors 34 and 36 to adjust the radial and tangential forces imparted to the workpiece 10 by the grinding wheels 18 and 22 so that the radial force imparted to the workpiece 10 by the grinding wheel 18 is substantially equal and opposed to the radial force imparted to the workpiece 10 by the grinding wheel 22 and the tangential force imparted to the workpiece 10 by the grinding wheel 18 is substantially equal and opposed to the tangential force imparted to the workpiece 10 by the grinding wheel 22. An increase in speed of the motors 34 and 36 will cause a decrease in the cutting forces. Alternately, instead of using the error signal on line 46 to control the speed of motors 34, 36 the error signal could be used to control automatic dressers for decreasing the wheels 18 and 20. If the sharpness of a wheel is increased, the force exerted on the workpiece by the grinding wheel will decrease. Other types of feedback systems could be utilized to control the forces exerted on the workpiece by each of the grinding wheels. For example, instead of finding the difference between the forces exerted by grinding wheels 18 and 22, the forces exerted by each of the grinding wheels could be compared to a reference and then adjusted to follow the reference signal rather than being compared to the other grinding wheel. Other controlled force systems utilizing spring or fluid forces could also be used to equalize the grinding forces imparted to the workpiece by wheels 18 and 22.

FIG. 5 illustrates a method and apparatus for controlling the force exerted on the workpiece 10 by the grinding wheels 18 and 22 wherein the parameters of the grinding wheels 18 and 22 are controlled to control the force imparted to the workpiece by each of the grinding wheels. By controlling the sharpness of the grinding wheel, the force imparted to the workpiece can be controlled. The sharper the grinding wheel is maintained, the less force will be required to remove a particular amount of material. It is known to automatically dress grinding wheels to control the sharpness thereof. The automatic dressing can be controlled by a feed-back system to control the forces imparted to the workpiece by the grinding wheel. Thus, by controlling the sharpness of the grinding wheels 18 and 22, the forces exerted by the grinding wheels on the workpiece 10 can be controlled.

The depth of cut of the grinding wheel can be controlled to control the force exerted upon the workpiece. The deeper the cut, the more force required and the greater the force exerted on the workpiece. As is schematically shown in FIG. 5, the roughing wheel 22 has a depth of cut of 62 and the finish wheel 18 has a depth of cut 60. Generally, the roughing wheel 22 will have a greater depth of cut than the finishing wheel 18.

The width of the wheel can also be chosen to control the force exerted on the workpiece by the grinding wheel. The wider the wheel, the greater the force that will be imparted to the workpiece by the grinding wheel. As is illustrated in FIG. 5, the roughing wheel 22 has a width 66 and the finish wheel 18 has a width 64. Generally, the roughing wheel 22 tends to exert a greater force per square inch of wheel surface engaging the workpiece than the finish wheel 18 due to the fact that the roughing wheel 22 tends to remove more material from the workpiece 10. Accordingly, if it is desired to balance the forces imparted to the workpiece 10 by the grinding wheel 18 and the grinding wheel 22 and all parameters of the wheel are fixed except for the width it is generally desirable to utilize a wider finishing wheel 18 and a narrower roughing wheel 22 to balance the forces on the workpiece 10 which are specifically related to the wheel width.

Controlling the wheel speed also controls the force imparted to the workpiece 10 by the grinding wheel. When the speed increases, the force imparted to the workpiece decreases. The increase in the wheel speed reduces the effective grain depth of cut of the grinding wheel and therefore, reduces the force imparted to the workpiece.

The wheel type also controls the force imparted to the workpiece by the grinding wheel. As grit size increases, the force decreases and as bond hardness increases for the bonding material utilized in the wheel, the force also increases. In addition, as the grit crystal friability increases, the force imparted by the grinding wheel to the workpiece decreases.

The force, both tangential and radial, imparted to the workpiece 10 by the grinding wheel 18 and by the wheel 22 can be controlled by controlling the sharpness of the grinding wheel, depth of cut of the grinding wheel, width of the grinding wheel, wheel speed and wheel type, including grit size, bond hardness and grit crystal friability. All of these variables can be chosen either manually or via an automatic control system prior to grinding so that the force imparted to the workpiece 10 by each of the grinding wheels 18 and 22 is substantially equal and opposed in direction to thereby minimize distortion of the workpiece in a radial direction. The initial force conditions imparted on the workpiece by each of the grinding wheels 18 and 22 can be approximately balanced by selecting the proper parameters for the above noted variables. During an actual grinding operation fine balance can be achieved by adjusting the wheel sharpness by automatic dressing and by adjusting the wheel speed.

Figure 3:
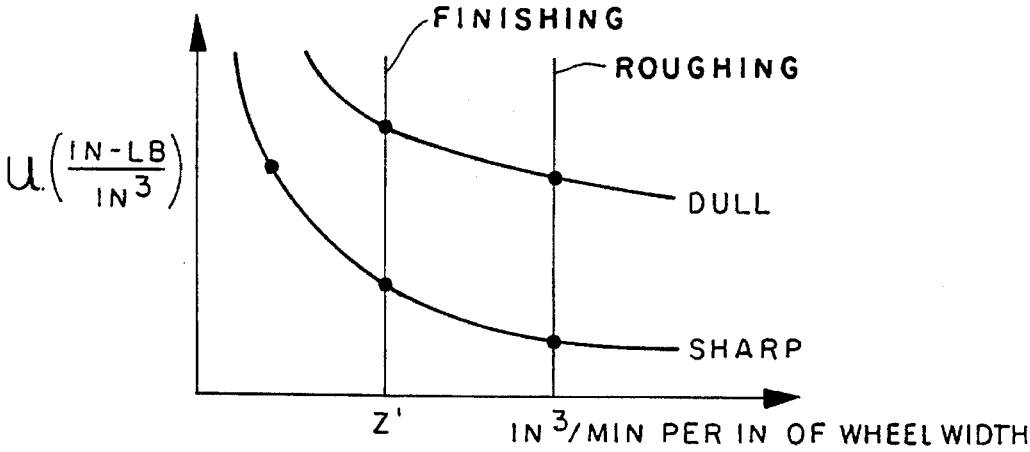
FIG. 3 is a graphical illustration of the relationship between grinding energy (U) and material removal rates (Z') using sharp and dull grinding wheels.

The force exerted on the workpiece 10 by each of the grinding wheels is related to the specific energy (U) which is the amount of grinding energy required to remove a unit volume of material from the workpiece (HP/IN$^3$/Min.). The specific energy is related to the horsepower required to drive the wheel and the cubic inches per minute of material removed. The specific energy is not a constant, but rather a function of the material removal rate (Z') and how sharp or dull the wheel is made by dressing the wheel. In general, U equals $F_T \times V_{wheel} \div Z' \times b$ where $F_T$ equals the tangential force on the grinding wheel in pounds, $V_{Wheel}$ equals the surface speed of the grinding wheel in inches per minute, Z' equals the specific material removal rate in In.$^2$/Min., and b equals the width of the grinding wheel in inches. FIG. 3 illustrates the relationship between the specific energy (U) and the material removal rate (Z') for both a finish wheel and a roughing wheel and discloses the relationship when the sharpness of the wheel is controlled between dull and sharp. Using the above identified formulas, $F_T$ equals $U\,Z'b/V_{wheel}$. Thus, by controlling wheel speed the tangential force can be directely controlled.

Figure 6:
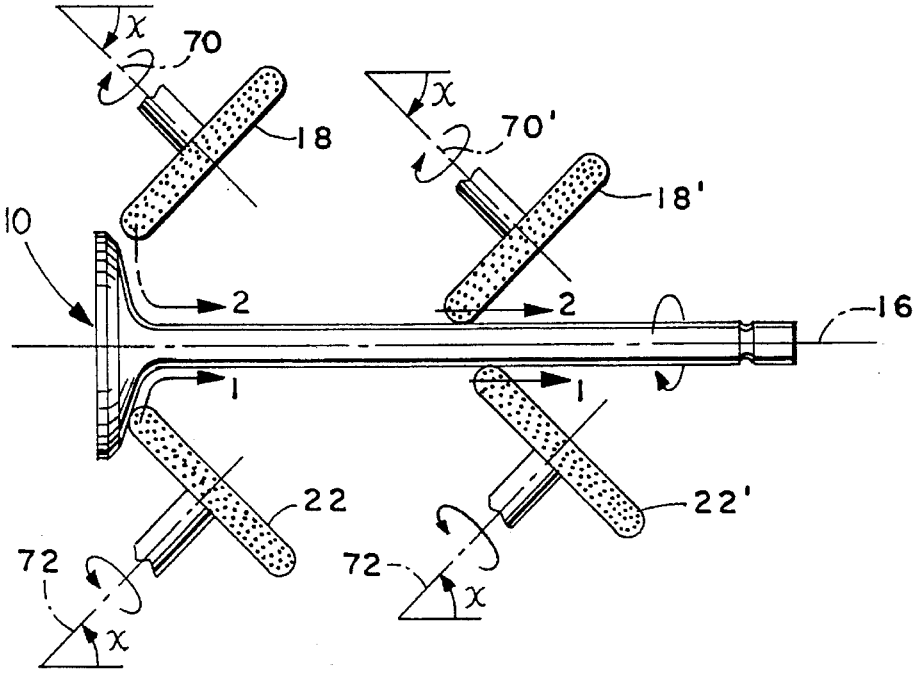
FIG. 6 is a schematic illustration of an apparatus for grinding a workpiece wherein the axis of rotation of each of the first and second grinding wheels is disposed at an acute angle to the axis of rotation of the workpiece.

Referring to FIG. 6, another embodiment of the present invention is illustrated wherein the axis of rotation of the grinding wheels 18 and 22 is disposed at an acute angle X relative to the axis of rotation 16 of the workpiece 10. The grinding wheel 18 in FIG. 6 is supported for rotation about an axis of rotation 70 which forms an acute angle X with the axis of rotation 16 of the workpiece 10. The grinding wheel 22 is supported for rotation about an axis of rotation 72 which is also disposed at an acute angle X relative to the axis of rotation 16 of the workpiece 10. In FIG. 6, the axis of rotation 16 of the workpiece and the axes of rotation 70 and 72 of the grinding wheels 18 and 22 respectively, are all disposed in a single plane. The force imparted to the workpiece 10 by the grinding wheels 18 and 22 can be controlled utilizing the methods disclosed in FIGS. 4–5. The apparatus and method described in FIG. 6 has the advantage over the apparatus disclosed in FIG. 1 in that the canted grinding wheels 18 and 22 can engage with the head portion 14 of the valve without sidewheeling and therefore increase the grinding rate.

Figure 7:
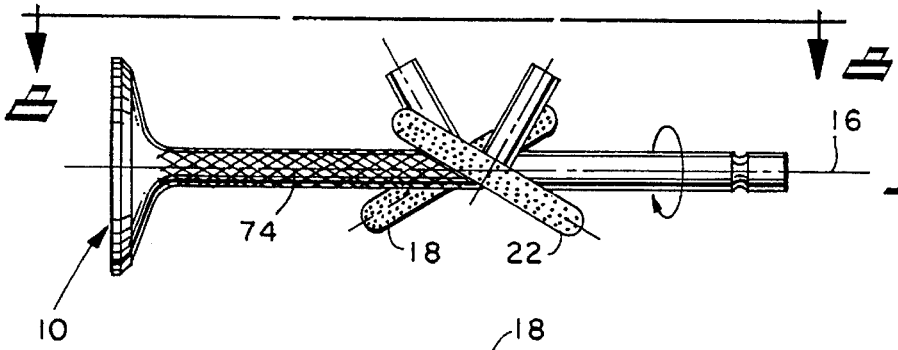
FIG. 7 schematically illustrates another embodiment of the invention wherein the axis of rotation of each of the grinding wheels is disposed at an acute angle relative to the axis of rotation of the workpiece and wherein the axis of rotation of the first grinding wheel does not intersect with the axis of rotation of the second grinding wheel.
Figure 8:
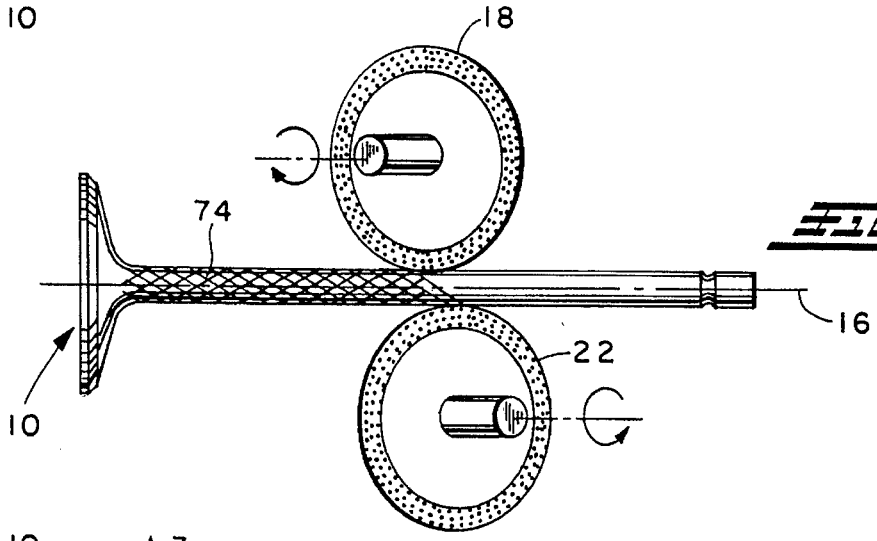
FIG. 8 is a side view of FIG. 7 taken approximately along lines 8—8 of FIG. 7.

FIGS. 7 and 8 discloses another embodiment of the present invention wherein the axis of rotation of each of the grinding wheels 18,22 is disposed at an acute angle B relative to the axis of rotation 16 of the workpiece and wherein the axis of rotation 16 of the workpiece 10 and the axis of rotation of each of the grinding wheels does not lie in a single plane.

Figure 9:
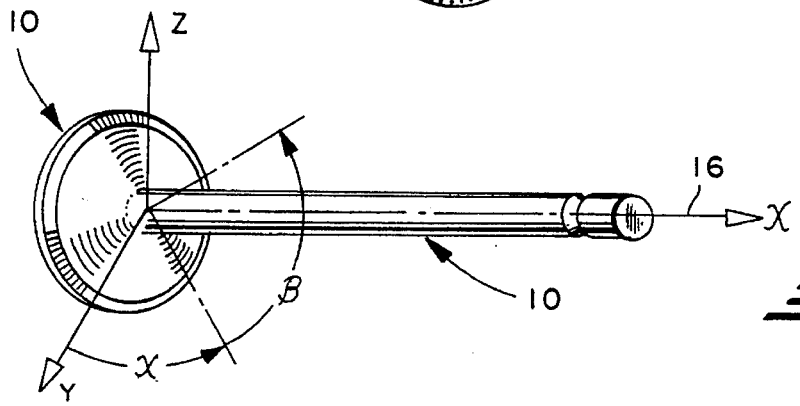
FIG. 9 is a schematic representation more fully illustrating the axis of rotation of the workpiece on the axis of the orthoginal system in which the first and second grinding wheels are disposed.

Referring more particularly to FIG. 9, the orthoginal system for defining the angular relationship between the axis of rotation 16 of the workpiece 10 and the axis of rotation of the grinding wheels is more fully illustrated. In FIG. 9, the axis of rotation 16 of the workpiece is defined as the X axis. In the embodiment disclosed in FIG. 6 the acute angle X between the axis of rotation of the workpiece (X axis) and the axis of rotation of each of the grinding wheels 18, 22 lies in the X-Y plane and hence, the axis of rotation of the workpiece and of the grinding wheels are all disposed in a single plane. In the embodiment disclosed in FIGS. 7 and 8, the axis of rotation of the workpiece 10 lies on the X axis and the acute angle B defined between the axis of rotation of the workpiece and the axis of rotation of each of the grinding wheels is located in the X-Z plane. Thus, in FIGS. 7 and 8, the axis of rotation of each of the grinding wheels 18, 22 and the axis of rotation 16 of the workpiece 10 do not lie in a single plane.

Figure 10:
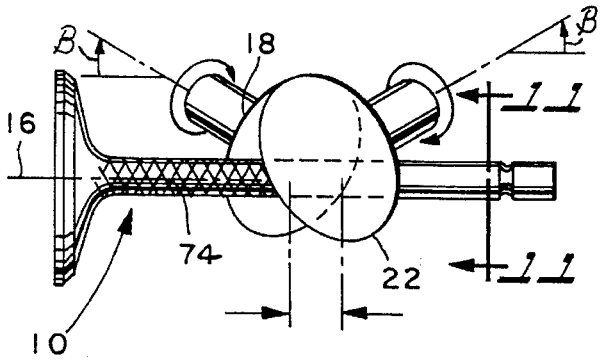
FIG. 10 is a schematic illustration of another embodiment of the invention.
Figure 11:
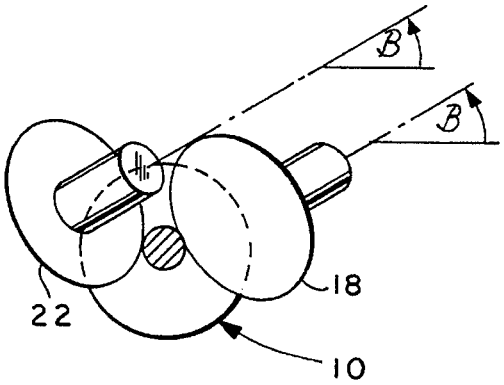
FIG. 11 is a side view taken approximately along the lines 11—11 of FIG. 10.
Figure 12:
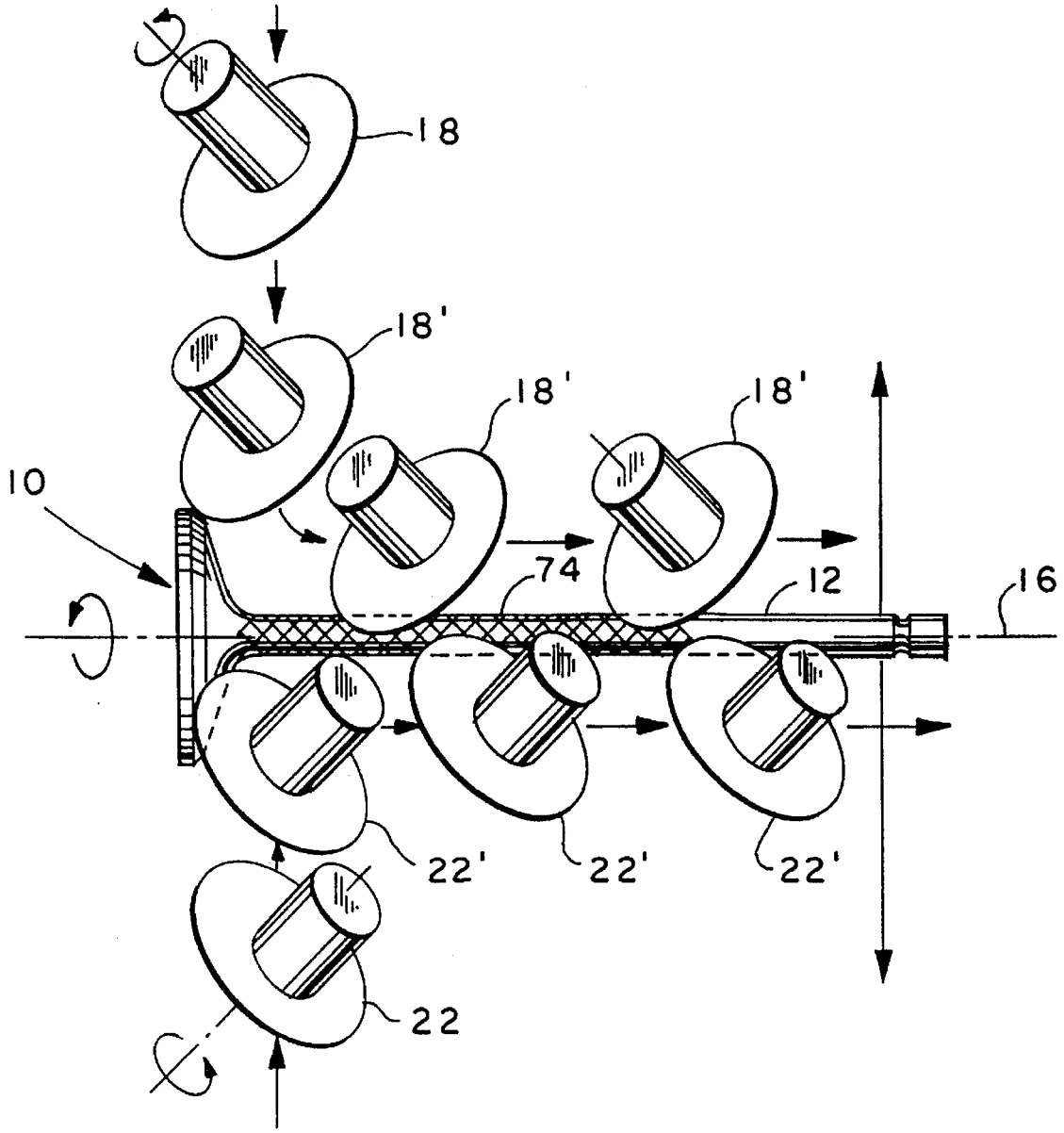
FIG. 12 is a schematic illustration of the apparatus of FIG. 10 schematically illustrating the sequential movement of the first and second grinding wheels as they engage and grind an internal combustion engine valve.

FIGS. 10–12 disclose a further embodiment of the invention wherein the axis of rotation of each of the grinding wheels 18, 22 is disposed at an acute angle X relative to the axis of rotation 16 of the workpiece 10 in the X-Y plane, and the axis of rotation of each of the grinding wheels 18, 20 is also disposed at an acute angle B relative to the axis of rotation 16 of the workpiece in the X-Z plane. The system disclosed in FIGS. 7, 8, 10, 11 and 12 enables the grinding marks on the valve stem 12 to form cross-hatching 74 which promotes stress planes in the valve stem which are effective to lessen stress arising from the bending and reciprocal tensile forces acting upon the stem in a direction substantially parallel to the central longitudinal axis of the valve stem 12. Whenever the B angle between the axis of rotation of the workpiece and the axis of rotation of the grinding wheels in the X-Z plane is greater than 0° cross hatching of the grinding marks occur.

The cross-hatched type pattern of grinding marks 74 which are disposed at an acute angle with respect to the central longitudinal axis of the valve stem 12 promote stress planes in the stem 12 that are effective to lessen stress arising from bending and reciprocating tensile forces acting upon the stem in a direction substantially parallel to the central longitudinal axis. Moreover, the cross-hatched surface pattern 74 provides for maintenance of an elastrohydro dynamic lubrication film between the valve stem 12 and the surrounding surface of a guide in which the stem reciprocates during operation of an internal combustion engine. As is described in U.S. Pat. No. 5,186,131, which is incorporated herein by reference, the acute angle maintained between the axis of rotation of the workpiece 16 and the axis of rotation of the grinding wheels preferably is about 30°–50° although other acute angles could be used with similar results. As in FIG. 1, the rough grinding wheel 22 precedes the finish grinding wheel 18 along the grinding path on the outside of the workpiece 10. The grinding wheels 18' and 22' in FIG. 12 represent sequential movement of the grinding wheels 18 and 22 as they grind the surface of workpiece 10.

The method and apparatus disclosed for grinding a workpiece utilizing a pair of grinding wheels which engage at substantially diametrically opposed portions of the workpiece is particularly useful when finishing elongate or brittle workpieces wherein the tangential and radial forces exerted on the workpiece by the grinding wheel affect distortion of the workpiece in a radial direction and where the workpiece is brittle and subject to fracturing when subjected to unbalanced radial or tangential forces. For example, it has been found that elongate engine valves tend to deflect with a single grinding wheel due to the grinding forces acting thereon when the valve is finished. This results in the necessity of either grinding the workpiece at a slower speed to lessen the forces or, taking multiple grinding passes to minimize the forces, or utilizing costly straightening processes to restraighten the valve stem subsequent to grinding. The disclosed method and apparatus is particularly useful when grinding elongate ceramic components such as valves for an internal combustion engine. When ceramics are utilized, the radial and tangential forces imparted to the valve stem by the grinding wheels can exert substantial shear stresses in the valve stem resulting in fracture thereof. Thus, prior to the present invention, the grinding process for ceramic valves was slow to reduce the material removal rates to minimize the tangential and radial grinding forces imparted to the workpiece. However, by utilizing the apparatus and method disclosed in the present invention whereby a pair of grinding wheels is utilized and wherein the grinding wheels are disposed at substantially diametrically opposed locations on the workpiece, the material removal rates can be increased without imparting undue radial and tangential forces to the workpiece. Thus, the grinding of the workpiece such as an internal combustion engine valve can be accomplished more rapidly and with greater control over tolerances due to the minimzation of distortion of the workpiece.

What is claimed is:

1. A dual wheel grinding machine comprising workpiece supporting means for supporting a workpiece for rotation about a first axis of rotation, a first grinding wheel supported for rotation about a second axis of rotation which is substantially parallel to said first axis of rotation, a second grinding wheel supported for rotation about a third axis of rotation which is substantially parallel to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, and control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation and wherein said control means for controlling the radial grinding force imparted to the workpiece by said first and second grinding wheels to be substantially opposed includes:

first means for controlling the width of the cutting surface of the first grinding wheel, the sharpness of the first grinding wheel and the depth of cut of the first grinding wheel to predetermine the radial grinding force exerted on the workpiece by said first grinding wheel, and second means for controlling the width of the cutting surface of said second grinding wheel, the sharpness of said second grinding wheel, the sharpness of said second grinding and the depth of cut of said second grinding wheel to preset the radial grinding force exerted on the workpiece by said second grinding wheel so that the radial grinding force exerted by the first grinding wheel is substantially opposed to the radial grinding force imparting to the workpiece by said second grinding wheel.

2. A dual wheel grinding machine as defined in claim 1 wherein said control means for controlling the radial grinding force imparted to the workpiece by said first and second grinding wheels includes:

mounting means for mounting said first grinding wheel for rotation about said second axis of rotation, mounting means for mounting said second grinding wheel for rotation about said third axis of rotation and means for imparting a radial force to said mounting means for said first grinding wheel and to said mounting means for said second grinding wheel and wherein the radial grinding force imparted to said first grinding wheel is substantially opposed to the radial grinding force imparted to the workpiece by said second grinding wheel.

3. A dual wheel grinding machine as defined in claim 2 wherein said first, second and third axes of rotation are all disposed in a single plane.

4. A dual wheel grinding machine as defined in claim 3 wherein said tangential grinding force imparted to the workpiece by said first grinding wheel is equal and opposed to said tangential grinding force imparted to the workpiece by said second grinding wheel.

5. A dual wheel grinding machine as defined in claims 1 wherein said first and second grinding wheels are movable in an axial direction relative to the workpiece and said first axis of rotation to progressively grind the workpiece and wherein said first means further controls the speed of relative axial movement between said first grinding wheel and said workpiece and said second means controls the speed of relative axial movement between said second grinding wheel and said workpiece, said first and second means controlling said axial movement of said first and second grinding wheels relative to said workpiece to control the radial grinding force exerted on said workpiece by said first grinding wheel to be substantially opposed to the radial grinding force imparted to said workpiece by said second grinding wheel.

6. A dual wheel grinding machine as defined in claim 1 wherein said first, second and third axes of rotation are all disposed in a single plane.

7. A dual wheel grinding machine comprising workpiece supporting means for supporting a workpiece for rotation about a first axis of rotation, a first grinding wheel supported for rotation about a second axis of rotation which is disposed at an acute angle relative to said first axis of rotation, a second grinding wheel supported for rotation about a third axis of rotation which is disposed at an acute angle relative to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, and control means for controlling the radial grinding force imparted to the workpiece by said first and second grinding wheels to control the radial grinding force imparted to the workpiece by said first grinding wheel to be substantially opposed to the radial grinding force imparted to the workpiece by second grinding wheel to prevent distortion of the workpiece in a radial direction relative to said first axis of rotation.

8. A dual wheel grinding machine as defined in claim 7 wherein each of said first and second grinding wheels include a grinding surface thereon which is engageable with the workpiece, said grinding surface of said first grinding wheel being disposed at an acute angle to said grinding surface of said second grinding wheel, said first and second grinding wheels imparting circumferentially spaced grinding marks on the workpiece oriented at an acute angle with respect to said first axis of rotation of the workpiece.

9. A dual wheel grinding machine as defined in claim 7 wherein said control means for controlling the radial grinding force imparted to the workpiece by said first and second grinding wheels to be substantially opposed includes:

first means for controlling the width of the cutting surface of said first grinding wheel, the sharpness of said first grinding wheel and the depth of cut of said first grinding wheel to predetermine the radial grinding force exerted on the workpiece by said first grinding wheel, and second means for controlling the width of the cutting surface of said second grinding wheel, the sharpness of said second grinding wheel and the depth of cut of said second grinding wheel to preset the radial grinding force exerted on the workpiece by said second grinding wheel so that the radial grinding force exerted by said first grinding wheel is substantially equal and opposed to the radial force imparted to said workpiece by said second grinding wheel.

10. A dual wheel grinding machine as defined in claim 9 wherein said first and second grinding wheels are movable in an axial direction relative to the workpiece and said first axis of rotation to progressively grind the workpiece and wherein said first means further controls the speed of relative axial movement of said first grinding wheel and said workpiece and said second means controls the speed of relative axial movement of said second grinding wheel and said workpiece, said first and second means controlling said axial movement of said first and second grinding wheels relative to said workpiece to control the radial grinding force exerted on said workpiece by said first grinding wheel to be substantially equal and opposed to the radial grinding force imparted to said workpiece by said second grinding wheel.

11. A dual wheel grinding machine as defined in claim 9 wherein said first, second and third axes of rotation are all disposed in a single plane.

12. A dual wheel grinding machine as defined in claim 7 wherein said first, second and third axes of rotation are all disposed in a single plane.

13. A dual wheel grinding machine as defined in claim 7 whereas said control means for controlling the radial grinding force imparted to the workpiece by said first and second grinding wheels includes:

mounting means for mounting said first grinding wheel for rotation about said second axis of rotation, mounting means for mounting said second grinding wheel for rotation about said third axis of rotation and means for imparting a force to said mounting means for said first grinding wheel and to said mounting means for said second grinding wheel and wherein the radial grinding force imparted to said first grinding wheel is substantially equal and opposed to the radial grinding force imparted to the workpiece by said second grinding wheel.

14. A dual wheel grinding machine as defined in claim 7 wherein said tangential grinding force imparted to the workpiece by said first grinding wheel is equal and opposed to said tangential grinding force imparted to the workpiece by said second grinding wheel.

15. A dual wheel grinding machine as defined in claim 7 wherein said second and third axis of rotation are nonintersecting.

16. A dual wheel grinding machine comprising workpiece supporting means for supporting a workpiece for rotation about a first axis of rotation, a first grinding wheel supported for rotation about a second axis of rotation which is disposed at an acute angle relative to said first axis of rotation, said first and second axes of rotation being non-intersecting, a second grinding wheel supported for rotation about a third axis of rotation which is disposed at an acute angle; relative to said first axis of rotation, said second and third axes of rotation being non-intersecting, said second axis of rotation being disposed at an angle less than or equal to 90° with respect to said third axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, and control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation.

17. A dual wheel grinding machine as defined in claim 16 wherein said control means for controlling the radial grinding force imparted to the workpiece by said first and second grinding wheels to be substantially opposed includes:

first means for controlling the width of the cutting surface of said first grinding wheel, the sharpness of said first grinding wheel and the depth of cut of said first grinding wheel to predetermine the radial grinding force exerted on the workpiece by said first grinding wheel, and second means for controlling the width of the cutting surface of said second grinding wheel, the sharpness of said second grinding wheel and the depth of cut of said second grinding wheel to preset the radial grinding force exerted on the workpiece by said second grinding wheel so that the radial grinding force exerted by said first grinding wheel is substantially equal and opposed to the radial force imparted to said workpiece by said second grinding wheel.

18. A dual wheel grinding machine as defined in claim 17 wherein said first and second grinding wheels are movable in an axial direction relative to the workpiece and said first axis of rotation to progressively grind the workpiece and wherein said first means further controls the speed of relative axial movement of said first grinding wheel and said workpiece and said second means further controls the speed of relative axial movement of said second grinding wheel and said workpiece, said first and second means controlling said axial movement of said first and second grinding wheels relative to said workpiece to control the radial grinding force exerted on said workpiece by said first grinding wheel to be substantially equal and opposed to the radial grinding force imparted to said workpiece by said second grinding wheel.

19. A dual wheel grinding machine as defined in claim 16 whereas said control means for controlling the radial grinding force imparted to the workpiece by said first and second grinding wheels includes:

mounting means for mounting said first grinding wheel for rotation about said second axis of rotation, mounting means for mounting said second grinding wheel for rotation about said third axis of rotation and means for imparting a radial force to said mounting means for said first grinding wheel and to said mounting means for said second grinding wheel and wherein the radial grinding force imparted to said first grinding wheel is substantially equal and opposed to the radial grinding force imparted to the workpiece by said second grinding wheel.

20. A dual wheel grinding machine as defined in claim 16 wherein each of said first and second grinding wheels include a grinding surface thereon and said grinding surface of said first grinding wheel is disposed substantially perpendicular to said grinding surface of said second grinding wheel, said first and second grinding wheels imparting circumferentially spaced grinding marks on the workpiece oriented at an acute angle with respect to said first axis of rotation of the workpiece.

21. A dual wheel grinding machine as defined in claim 20 wherein said circumferentially spaced grinding marks imparted to the workpiece by said first grinding wheel are substantially perpendicular to the circumferentially spaced grinding marks imparted to the workpiece by said second grinding wheel.

22. A dual wheel grinding machine as defined in claim 16 wherein said tangential grinding force imparted to the workpiece by said first grinding wheel is equal and opposed to said tangential grinding force imparted to the workpiece by said second grinding wheel.

23. A method of grinding an internal combustion engine valves using first and second grinding wheels which simultaneously grind the valve comprising the steps of:

supporting an internal combustion engine valve having a head portion and an elongate stem portion having a central longitudinal axis;

rotating the internal combustion valve about first axis of rotation which is substantially coextensive with the central longitudinal axis of the stem portion;

rotating a first grinding wheel about a second axis of rotation;

rotating a second grinding wheel about a third axis of rotation;

simultaneously engaging said first and second grinding wheels with said internal combustion engine valve wherein said first grinding wheel engages with said internal combustion engine valve at a location which is substantially diametrically opposed to the location at which said second grinding wheel engages with the internal combustion engine valve;

imparting a tangential and radial grinding force to the internal combustion engine valve by engagement of said first grinding wheel with the internal combustion engine valve;

imparting a tangential and radial grinding force to the internal combustion engine valve by engagement of said second grinding wheel with the internal combustion engine valve; and controlling the radial grinding force imparted to the internal combustion engine valve by said first and second grinding wheels to control the radial grinding force imparted to the internal combustion engine valve by said first grinding wheel to be substantially opposed to the radial grinding force imparted to the internal combustion engine valve by said second grinding wheel to prevent distortion of the valve stem in a radial direction relative to the central longitudinal axis of the valve stem.

24. A method of grinding an internal combustion engine valve using first and second grinding wheels which simultaneously grind the valve as defined in claim 23 wherein said second and third axes of rotation are disposed at an acute angle to said first axis of rotation.

25. A method of grinding an internal combustion engine valve using first and second grinding wheels which simultaneously grind the valve as defined in claim 24 wherein said second and third axes of rotation are non-intersecting.

26. A method of grinding an internal combustion engine valve using first and second grinding wheels which simultaneously grind the valve as defined in claim 23 wherein said radial grinding force imparted to said engine valve by said first and second grinding wheels is controlled by controlling the sharpness of said first and second grinding wheels.

27. A method of grinding an internal combustion engine valve using first and second grinding wheels which simultaneously grind the valve as defined in claim 23 wherein said radial grinding force imparted to said engine valve by said first and second grinding wheels is controlled by controlling the depth of cut of said first and second grinding wheels.

28. A method of grinding an internal combustion engine valve using first and second grinding wheels which simultaneously grind the valve as defined in claim 23 wherein said radial grinding force imparted to said engine valve by said first and second grinding wheels is controlled by controlling the width of said first and second grinding wheels.

29. A method of grinding an internal combustion engine valve using first and second grinding wheels which simultaneously grind the valve as defined in claim 23 wherein said radial grinding force imparted to said engine valve by said first and second grinding wheels is controlled by controlling the wheel speed of said first and second grinding wheels.

30. A method of grinding an internal combustion engine valve using first and second grinding wheels which simultaneously grind the valve as defined in claim 23 wherein said radial grinding force imparted to said engine valve by said first and second grinding wheels is controlled by controlling the wheel type including grit size and bond hardness of said first and second grinding wheels.

31. A dual wheel grinding machine comprising workpiece supporting means for supporting a workpiece for rotation about a first axis of rotation, a first grinding wheel supported for rotation about a second axis of rotation which is substantially parallel to said first axis of rotation, a second grinding wheel supported for rotation about a third axis of rotation which is substantially parallel to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation, a first force sensor associated with the first grinding wheel for sensing the radial grinding force imparted to the workpiece by said first grinding wheel and a second force sensor associated with the second grinding wheel for sensing the radial grinding force imparted to the workpiece by said second grinding wheel and wherein said control means is responsive to said first and second force sensors to control the radial grinding force imparted to said workpiece by said first and second grinding wheels so that the radial grinding force imparted to the workpiece by said first grinding wheel is substantially opposed to the radial grinding force imparted to said workpiece by said second grinding wheel.

32. A dual wheel grinding machine comprising workpiece supporting means for supporting a workpiece for rotation about a first axis of rotation, a first grinding wheel supported for rotation about a second axis of rotation which is substantially parallel to said first axis of rotation, a second grinding wheel supported for rotation about a third axis of rotation which is substantially parallel to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding forcerelative to said first axis of rotation to the workpiece, control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation, wherein said control means for controlling the radial grinding force imparted to the workpiece by said first and second grinding wheels to be substantially opposed includes: first means for controlling the width of the cutting surface of said first grinding wheel, the sharpness of said first grinding wheel and the depth of cut of said first grinding wheel to predetermine the radial grinding force exerted on the workpiece by said first grinding wheel, second means for controlling the width of the cutting surface of said second grinding wheel, the sharpness of said second grinding wheel and the depth of cut of said second grinding wheel to preset the radial grinding force exerted on the workpiece by said second grinding wheel so that the radial grinding force exerted by said first grinding wheel is substantially opposed to the radial force imparted to said workpiece by said second grinding wheel, wherein said first and second grinding wheels are movable in an axial direction relative to the workpiece and said first axis of rotation to progressively grind the workpiece and wherein said first means further controls the speed of relative axial movement between said first grinding wheel and said workpiece and said second means controls the speed of relative axial movement between said second grinding wheel and said workpiece, said first and second means controlling said axial movement of said first and second grinding wheels relative to said workpiece to control the radial grinding force exerted on said workpiece by said first grinding wheel to be substantially opposed to the radial grinding force imparted to said workpiece by said second grinding wheel, wherein each of said first and second grinding wheels include a grinding surface thereon for engagement with the workpiece, said first grinding wheel is a roughing grinding wheel and said second grinding wheel is a finishing grinding wheel, said first grinding wheel sequentially moving in a direction substantially parallel to said first axis of a rotation to rough grind the workpiece while said second grinding wheel sequentially moves in a direction substantially parallel to said first axis of rotation to finish grind the workpiece and wherein said first grinding wheel precedes said second grinding wheel to rough grind the workpiece prior to finish grinding the workpiece.

33. A dual wheel grinding machine comprising workpiece supporting means for supporting a workpiece for rotation about a first axis of rotation, a first grinding wheel supported for rotation about a second axis of rotation which is substantially parallel to said first axis of rotation, a second grinding wheel supported for rotation about a third axis of rotation which is substantially parallel to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, and control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation, wherein each of said first and second grinding wheels include a grinding surface thereon for engagement with the workpiece, said first grinding wheel is a roughing grinding wheel and said second grinding wheel is a finishing grinding wheel, said first grinding wheel sequentially moving in a direction substantially parallel to said first axis of a rotation to rough grind the workpiece while said second grinding wheel sequentially moves in a direction substantially parallel to said first axis of rotation to finish grind the workpiece and wherein said first grinding wheel precedes said second grinding wheel to rough grind the workpiece prior to finish grinding the workpiece.

34. A dual wheel grinding machine comprising workpiece supporting means for supporting a workpiece for rotation about a first axis of rotation, a first grinding wheel supported for rotation about a second axis of rotation which is substantially parallel to said first axis of rotation, a second grinding wheel supported for rotation about a third axis of rotation which is substantially parallel to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, and control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation, said control means for controlling the radial grinding force imparted to the workpiece by said first and second grinding wheels includes:

mounting means for mounting said first grinding wheel for rotation about said second axis of rotation, mounting means for mounting said second grinding wheel for rotation about said third axis of rotation and means for imparting a radial force to said mounting means for said first grinding wheel and to said mounting means for said second grinding wheel and wherein the radial grinding force imparted to said first grinding wheel is substantially opposed to the radial grinding force imparted to the workpiece by said second grinding wheel, wherein each of said first and second grinding wheels include a grinding surface thereon for engagement with the workpiece, said first grinding wheel is a roughing grinding wheel and said second grinding wheel is a finishing grinding wheel, said first grinding wheel sequentially moving in a direction substantially parallel to said first axis of a rotation to rough grind the workpiece while said second grinding wheel sequentially moves in a direction substantially parallel to said first axis of rotation to finish grind the workpiece and wherein said first grinding wheel precedes said second grinding wheel to rough grind the workpiece prior to finish grinding the workpiece.

35. A dual wheel grinding machine comprising workpiece supporting means for supporting a workpiece for rotation about a first axis of rotation, a first grinding wheel supported for rotation about a second axis of rotation which is substantially parallel to said first axis of rotation, a second grinding wheel supported for rotation about a third axis of rotation which is substantially parallel to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation, wherein said tangential grinding force imparted to the workpiece by said first grinding wheel is equal and opposed to said tangential grinding force imparted to the workpiece by said second grinding wheel.

36. A dual wheel grinding machine comprising workpiece supporting means for supporting a workpiece for rotation about a first axis of rotation, a first grinding wheel supported for rotation about a second axis of rotation which is disposed at an acute angle relative to said first axis of rotation, a second grinding wheel supported for rotation about a third axis of rotation which is disposed at an acute angle relative to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, control means for controlling the radial grinding force imparted to the workpiece by said first and second grinding wheels to control the radial grinding force imparted to the workpiece by said first grinding wheel to be substantially opposed to the radial grinding force imparted to the workpiece by second grinding wheel to prevent distortion of the workpiece in a radial direction relative to said first axis of rotation, a first force sensor associated with the first grinding wheel for sensing the radial grinding force imparted to the workpiece by said first grinding wheel and a second force sensor associated with the second grinding wheel for sensing the radial grinding force imparted to the workpiece by said second grinding wheel and wherein said control means is responsive to said first and second force sensors to control the radial grinding force imparted to said workpiece by said first and second grinding wheels so that the radial grinding force imparted to the workpiece by said first grinding wheel is substantially opposed to the radial grinding force imparted to said workpiece by said second grinding wheel.

37. A dual wheel grinding machine comprising workpiece supporting means for supporting a workpiece for rotation about a first axis of rotation, a first grinding wheel supported for rotation about a second axis of rotation which is disposed at an acute angle relative to said first axis of rotation, a second grinding wheel supported for rotation about a third axis of rotation which is disposed at an acute angle relative to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, and control means for controlling the radial grinding force imparted to the workpiece by said first and second grinding wheels to control the radial grinding force imparted to the workpiece by said first grinding wheel to be substantially opposed to the radial grinding force imparted to the workpiece by second grinding wheel to prevent distortion of the workpiece in a radial direction relative to said first axis of rotation, wherein said control means for controlling the radial grinding force imparted to the workpiece by said first and second grinding wheels to be substantially opposed includes:

first means for controlling the width of the cutting surface of said first grinding wheel, the sharpness of said first grinding wheel and the depth of cut of said first grinding wheel to predetermine the radial grinding force exerted on the workpiece by said first grinding wheel, second means for controlling the width of the cutting surface of said second grinding wheel, the sharpness of said second grinding wheel and the depth of cut of said second grinding wheel to preset the radial grinding force exerted on the workpiece by said second grinding wheel so that the radial grinding force exerted by said first grinding wheel is substantially equal and opposed to the radial force imparted to said workpiece by said second grinding wheel, wherein each of said first and second grinding wheels include a grinding surface thereon for engagement with the workpiece, said first grinding wheel is a roughing grinding wheel and said second grinding wheel is a finishing grinding wheel, said first grinding wheel sequentially moving in a direction substantially parallel to said first axis of a rotation to rough grind the workpiece while said second grinding wheel sequentially moves in a direction substantially parallel to said first axis of rotation to finish grind the workpiece and wherein said first grinding wheel precedes said second grinding wheel to rough grind the workpiece prior to finish grinding the workpiece.

38. A dual wheel grinding machine comprising workpiece supporting means for supporting a workpiece for rotation about a first axis of rotation, a first grinding wheel supported for rotation about a second axis of rotation which is disposed at an acute angle relative to said first axis of rotation, said first and second axes of rotation being non-intersecting, a second grinding wheel supported for rotation about a third axis of rotation which is disposed at an acute angle relative to said first axis of rotation, said second and third axes of rotation being non-intersecting, said second axis of rotation being disposed at an angle less than or equal to 90° with respect to said third axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece, control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation, a first force sensor associated with the first grinding wheel for sensing the radial grinding force imparted to the workpiece by said first grinding wheel and a second force sensor associated with the second grinding wheel for sensing the radial grinding force imparted to the workpiece by said second grinding wheel and wherein said control means is responsive to said first and second force sensors to control the radial grinding force imparted to said workpiece by said first and second grinding wheels so that the radial grinding force imparted to the workpiece by said first grinding wheel is substantially equal and opposed to the radial grinding force imparted to said workpiece by said second grinding wheel.

39. A dual wheel grinding machine comprising workpiece supporting means for supporting a workpiece for rotation about a first axis of rotation, a first grinding wheel supported for rotation about a second axis of rotation which is disposed at an acute angle relative to said first axis of rotation, said first and second axes of rotation being non-intersecting, a second grinding wheel supported for rotation about a third axis of rotation which is disposed at an acute angle relative to said first axis of rotation, said second and third axes of rotation being non-intersecting, said second axis of rotation being disposed at an angle less than or equal to 90° with respect to said third axis of rotation, said first grinding wheel being operable to engage with said workpiece at a location which is substantially diametrically opposed to the location at which said second grinding wheel engages with said workpiece, wherein each of said first and second grinding wheels imparting a tangential grinding force and a radial grinding force relative to said first axis of rotation to the workpiece, and control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation, each of said first and second grinding wheels include a grinding surface thereon for engagement with the workpiece, said first grinding wheel is a roughing grinding wheel and said second grinding wheel is a finishing grinding wheel, said first grinding wheel sequentially moving in a direction substantially parallel to said first axis of a rotation to rough grind the workpiece while said second grinding wheel sequentially moves in a direction substantially parallel to said first axis of rotation to finish grind the workpiece and wherein said first grinding wheel precedes said second grinding wheel to rough grind the workpiece prior to finish grinding the workpiece.

40. A dual wheel grinding machine as defined in claim 39 wherein said tangential grinding force imparted to the workpiece by said first grinding wheel is equal and opposed to said tangential grinding force imparted to the workpiece by said second grinding wheel.

41. A dual wheel grinding machine comprising workpiece supporting means for supporting a workpiece for rotation about a first fixed axis of rotation, a first grinding wheel supported for rotation about a second axis of rotation which is substantially parallel to said first axis of rotation, a second grinding wheel supported for rotation about a third axis of rotation which is substantially parallel to said first axis of rotation, said first grinding wheel being operable to engage with said workpiece at a location which is substantially diametrically opposed to the location at which said second grinding wheel engages with said workpiece, each of said first and second grinding wheels imparting a tangential grinding force and a radial grinding force relative to said first axis of rotation to the workpiece;

control means for controlling the radial grinding force imparted to the workpiece by said first and second grinding wheels to control the radial grinding force imparted to the workpiece by said first grinding wheel to be substantially opposed to the radial grinding force imparted to the workpiece by said second grinding wheel to prevent distortion of the workpiece in a radial direction relative to said first axis of rotation, said control means being adaptive to balance the forces imparted to the workpiece by the first and second grinding wheels.

* * * * *